United States Patent [19]

Kasamatsu

[11] 4,380,001

[45] Apr. 12, 1983

[54] ELECTRIC SAFETY DEVICE

[76] Inventor: Mikizo Kasamatsu, No. 22-7, Korikitano-cho, Neyagawa-shi, Osaka-fu, Japan

[21] Appl. No.: 281,244

[22] Filed: Jul. 7, 1981

[51] Int. Cl.[3] ..... H01H 85/00

[52] U.S. Cl. ..... 337/4; 337/5; 337/403

[58] Field of Search ..... 337/3, 4, 5, 6, 7, 404, 337/403

[56] References Cited

U.S. PATENT DOCUMENTS 2,247,902 7/1941 Bahr ..... 337/404

2,367,639 1/1945 Conboy ..... 337/404

FOREIGN PATENT DOCUMENTS 1095264 12/1967 United Kingdom ..... 337/3

*Primary Examiner*—Harold Broome

*Attorney, Agent, or Firm*—Larson and Taylor

[57] ABSTRACT

The present invention discloses an electric safety device in which a fuse element adapted to break a circuit upon passage of an overcurrent and a circuit-breaking conductive member of the heat-sensitive type for preventing overheat are housed in one vessel and are electrically connected to each other, so that the circuit of an electrical appliance can be broken with respect to both overcurrent and overheat.

2 Claims, 4 Drawing Figures

ELECTRIC SAFETY DEVICE

BACKGROUND OF THE INVENTION

Conventionally, there are variously researched and developed electric safety devices of the type comprising a fuse element adapted to break an electric circuit upon passage of an overcurrent in an electrical appliance, and of the heat-sensitive type adapted to break an electric circuit when an electric appliance is overheated to a temperature exceeding a predetermined safe temperature. Such conventional safety device of the respective type has itself excellent safety characteristics. However, perfect safety cannot be provided by a safety device having only a function to break the electric circuit by the fusing of fuse element on passage of an overcurrent, or a function to break the electric circuit by a circuit-breaking conductive member of the heat-sensitive type when the electrical appliance is overheated to a temperature exceeding a predetermined safe temperature. Namely, no matter how excellent the fuse element may be, such safety device cannot fulfil a safety function if the electric appliance is overheated, independently of an overcurrent. On the other hand, no matter how excellent the circuit-breaking conductive member of the heat-sensitive type may be, such safety device cannot fulfil a safety function on passage of an overcurrent independent from overheat. Thus, such conventional safety devices of the respective types cannot disadvantageously prevent damage of electrical appliance and occurrence of fire accident due to overheat or overcurrent.

SUMMARY OF THE INVENTION

The present invention relates to improvements in an electric safety device, and more particularly to an electric safety device comprising a vessel, a fuse element adapted to break a circuit upon passage of an overcurrent, said fuse element connected to one lead wire and housed in the vessel at one side thereof, and a circuit-breaking conductive member of the heat-sensitive type to prevent overheat, said conductive member connected to the other lead wire and housed in the vessel at the other side thereof, said fuse element and said conductive member being electrically connected to each other.

It is a main object of the present invention to provide an electric safety device having a function to break an electric circuit upon passage of an overcurrent in an electrical appliance, as well as a function to break the electric circuit when such electrical appliance is overheated to a temperature exceeding a predetermined safe tempereture, thereby to assure safety with respect to both overcurrent and overheat, thus enabling to improve electric safety to a great extent.

It is another object of the present invention to provide an electric safety device in an integral structure having two kinds of electric circuit breaking function as above-mentioned, which can be installed readily and easily in an electrical appliance of every kind in a compact manner.

BRIEF DESCRIPTION OF THE DRAWINGS

The present invention will be further described, by way of example, with reference to the accompanying drawings, in which.

DETAILED DESCRIPTION OF THE PREFERRED EMBODIMENTS

The description hereinafter will discuss in detail embodiments of an electric safety device in accordance with the present invention, with reference to the accompanying drawings.

Figure 1:
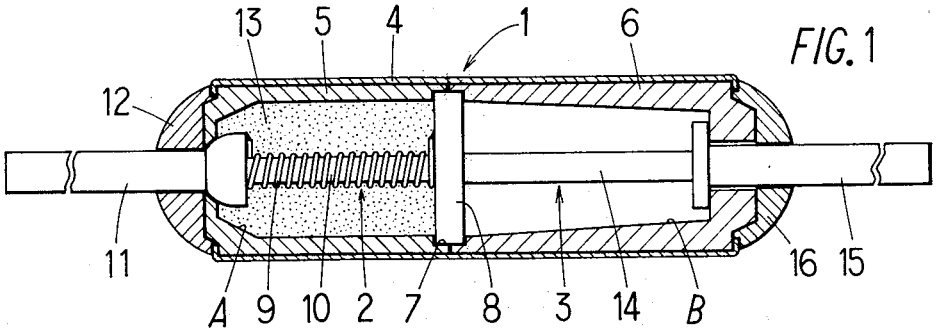
FIG. 1 is a front view, with portions in longitudinal section elevation, of a first embodiment of electric safety device in accordance with the present invention.
Figure 2:
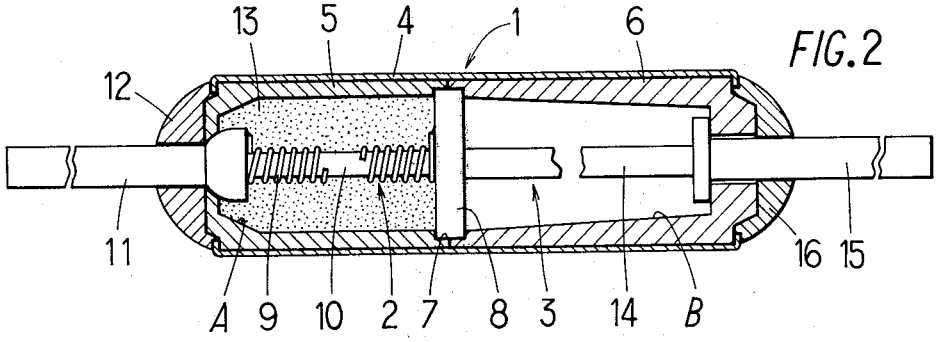
FIG. 2 is a view similar to FIG. 1, but illustrating a state where both a fuse element and a circuit-breaking conductive member of the heat-sensitive type shown in FIG. 1 are simultaneously operated in breaking the electric circuit.

An electric safety device shown in FIGS. 1 and 2 essentially comprises a vessel 1 forming a main body, a fuse element 2 adapted to break an electric circuit upon passage of an overcurrent, and a circuit-breaking conductive member of the heat-sensitive type 3 for preventing overheat, the fuse element 2 and the conductive member 3 being housed in the vessel 1.

The vessel 1 comprises a metallic cylindrical member 4 having open ends and made of aluminium, copper or the like, tubes 5 and 6 inserted into the metallic cylindrical member 4 from the both ends thereof and made of an electrically insulating material such as plastic, and a disk-shape electric connecting member 8 fitted into a ring-shape groove 7 formed in the inner peripheries of the abutting faces of the both tubes 5 and 6, the electric connecting member 8 being made of material having a good electric conduction such as copper, phosphor bronze or the like. The vessel 1 is divided into two chambers A and B by the electric connecting member 8.

The fuse element 2 adapted to break a circuit upon passage of an overcurrent comprises a metallic wire 9 of the wellknown type to be fused upon passage of an overcurrent, and an electrically insulating core member 10 made of nylon or the like on which the metallic wire 9 is spirally wound at predetermined intervals. This fuse element 2 is housed in one chamber A of the vessel 1. The tip end of the metallic wire 9 is connected to the electric connecting member 8 by soldering, and the base end of the metallic wire 9 is connected to one end of a lead wire 11 by soldering. The other end of the lead wire 11 is taken out to the outside of the vessel. A seal cap 12 is disposed at that portion of the lead wire 11 which is taken out from the vessel. The chamber A is filled with extinction agent 13 for performing an extinction action and preventing the wound metallic wire 9 from coming in contact with each other on the surface of the core 10.

The circuit-breaking conductive member of the heat-sensitive type 3 for preventing overheat comprises a wire 14 made of solder metal, the surface of which is coated with pine resin. The wire 14 is housed in the other chamber B of the vessel 1. The tip end of the wire 14 is connected to the electric connecting member 8 by soldering. The base end of the wire 14 is connected to one end of a lead wire 15 by soldering. The other end of the lead wire 15 is taken out to the outside of the vessel 1. A seal cap 16 is disposed at that portion of the lead wire 15 which is taken out from the vessel 1.

Pine resin is coated on the surface of the solder wire 14, because the characteristics of such pine resin can compensate for a defect that, when overheated, the solder wire is softened and turned thereby to hang down as not-fused so that a predetermined breaking effect based on a heat-sensitive property cannot be securely performed in good timing. Thus, with the aid of pine resin, the wire can be fused smoothly and securely.

The electric safety device constructed as discussed hereinbefore may be applied to the electric circuit of an electrical appliance of every kind with the lead wires 11 and 15 connected thereto.

With such arrangement, if an overcurrent is flowed in the circuit of an electrical appliance equipped with the safety device of the present invention, the metallic wire 9 of the fuse element 2 is fused to break the circuit, thereby to turn off electricity. If the portion of the electrical appliance at which the safety device is mounted is overheated for some reason, the solder wire 14 of the circuit-breaking conductive member of the heat-sensitive type 3 is overheated and fused to break the circuit of the appliance, thereby to turn off electricity.

If an overcurrent is flowed to the appliance which is simultaneously overheated, both the metallic wire 9 of the fuse element 2 and the solder wire 14 of the circuit-breaking conductive member of the heat-sensitive type 3 are fused, as shown in FIG. 2, to break the circuit, thereby to turn off electricity.

Figure 3:
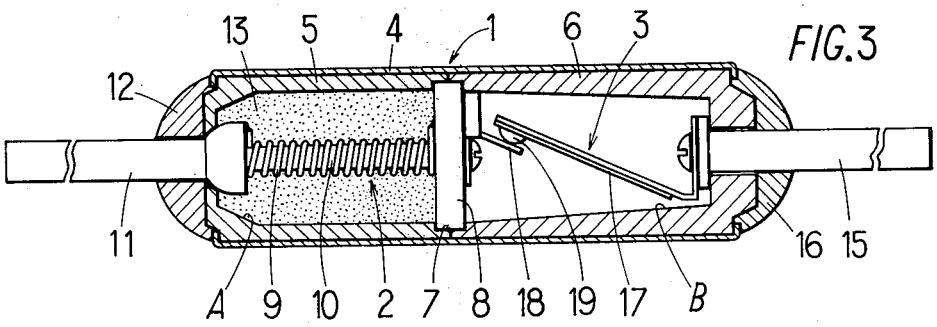
FIG. 3 is a front view, with portions in longitudinal section elevation, of a second embodiment of electric safety device in accordance with the present invention.
Figure 4:
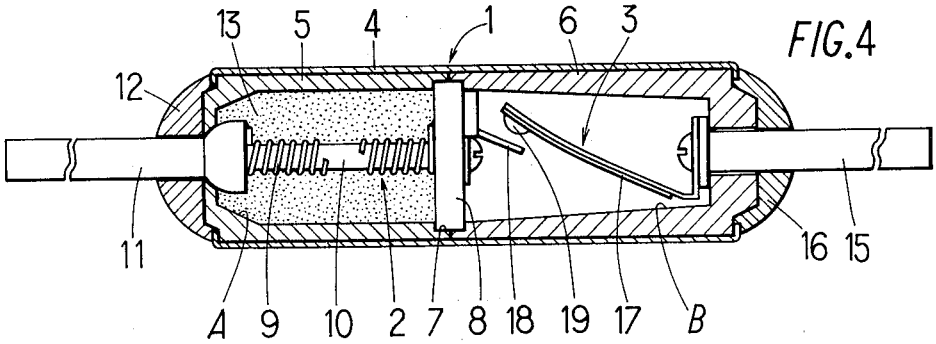
FIG. 4 is a view similar to FIG. 3, but illustrating a state where both a fuse element and a circuit-breaking conductive member of the heat-sensitive type shown in FIG. 3 are simultaneously operated in breaking the circuit.

A second embodiment of electric safety device in accordance with the present invention is shown in FIGS. 3 and 4, in which like parts are designated by like numerals used in FIGS. 1 and 2.

The second embodiment is different from the first embodiment only in the construction of the circuit-breaking conductive member of the heat-sensitive type 3.

In the second embodiment, the circuit-breaking conductive member of the heat-sensitive type 3 comprises a thermostat switch 17. The thermostat switch 17 has a fixed switch member 18 having a base end connected to the electric connecting member 8 by soldering, and a bimetal heat-sensitive movable switch member 19 having a base end connected to the lead wire 15 by soldering.

As shown in FIG. 3, the switch members 18 and 19 normally come in contact with each other to maintain electrical contact therebetween. If the portion of an electrical appliance at which the safety device of the present invention is mounted, is overheated, the switch member 19 is heated and deformed, thereby to be separated from the switch member 18 to break the circuit, thus turning off electricity.

Other operations are the same as those performed by the first embodiment shown in FIGS. 1 and 2.

As apparent from the description hereinbefore, according to the electric safety device of the present invention, in either case where an overcurrent is flowed in the circuit of an electrical appliance equipped with the present safety device, or the portion of the electrical appliance at which the present safety device is mounted, is extraordinarily overheated for some reason, the circuit is securely broken to turn off electricity, so that electric safety can be considerably improved. In addition, according to the present invention, since two kinds of electric circuit breaking function are incorporated in a single structure, the present safety device can be readily and easily installed in an electrical appliance of every kind in a compact manner.

Although preferred embodiments of the present invention have been discussed and illustrated, the present invention is not limited thereto. For example, there can be used a wide variety of fuse elements adapted to break an electric circuit upon passage of an overcurrent including a time delay fuse element. Thus, various changes and modifications of the present invention may be made without departing from the scope and spirit of the present invention.

What I claim is:

1. An electrical safety device comprising:

a housing;

an electrically conducting wall member located within said housing and dividing said housing into first and second chambers;

a first electrical lead wire penetrating said housing, said first electrical lead wire having an outer end outside of said housing for connection in an electrical circuit and having an inner end in said first chamber for connection to a first fuse element;

a second electrical lead wire penetrating said housing, said second electrical lead wire having an outer end outside of said housing for connection in an electrical circuit, and having an inner end in said second chamber for connection to a second fuse element;

a first fuse element adapted to break an electrical circuit on passage of an overcurrent, said first fuse element being provided in said first chamber and comprising an electrically conducting element electrically connected in series between said inner end of said first electrical lead wire and said electrically conducting wall member; and a second fuse element adapted to break an electrical circuit on being heated above a predetermined temperature, said second fuse element comprising an electrically conducting solder metallic wire, the surface of which is coated with pine resin, said solder wire being electrically connected in series between said inner end of said second electrical lead wire and said electrically conducting wall member.

2. An electrical safety device according to claim 1, wherein said housing comprises:

a metallic outer cylindrical member having open ends;

a first tubular, electrically non-conductive, member fitted into a first end of said outer cylindrical member;

a second tubular, electrically non-conductive, member fitted into the second end of said outer cylindrical member with its inner end abutting the inner end of said first tubular member, at least one of said first and second tubular members being provided at its inner end and on its inner tube wall with a ring-shaped groove;

said wall member comprising a disc positioned in said ring-shaped groove;

a first electrically non-conductive seal cap closing the first end of said outer cylindrical member, said first electrical lead wire extending therethrough; and a second electrically non-conductive seal cap closing the second end of said outer cylindrical member, said second electrical lead wire extending therethrough;

said first chamber being formed by said first non-conductive tubular member, said first non-conductive seal cap and said electrically conducting disc wall member; and said second chamber being formed by said second non-conductive tubular member, said second non-conductive seal cap, and said electrically conducting disc wall member.

* * * * *